US005440365A

United States Patent [19]

Gates et al.

[11] Patent Number: 5,440,365

[45] Date of Patent: Aug. 8, 1995

[54] PHOTOSENSITIVE MATERIAL PROCESSOR

[75] Inventors: Edgar P. Gates, Honeoye; John H. Hilton, Hilton; Frank S. Warzeski, Spencerport, all of N.Y.

[73] Assignee: Eastman Kodak Company, Rochester, N.Y.

[21] Appl. No.: 137,243

[22] Filed: Oct. 14, 1993

[51] Int. Cl.[6] ..... G03D 13/00

[52] U.S. Cl. ..... 354/298; 354/334

[58] Field of Search ..... 354/298, 299, 324, 334; 355/27-29, 77

[56] References Cited

U.S. PATENT DOCUMENTS

| | | | |
|---|---|---|---|
| 3,680,463 | 8/1972 | Attridge et al. | 354/298 |
| 3,995,959 | 12/1976 | Shaber | 354/298 X |
| 4,004,923 | 1/1977 | Hensel | 430/396 |
| 4,134,664 | 1/1979 | Morokuma et al. | 354/298 |
| 4,166,701 | 9/1979 | Miller | 356/404 |
| 4,168,120 | 9/1979 | Freier et al. | 355/38 |
| 4,174,173 | 11/1979 | Pone, Jr. | 355/38 |
| 4,335,956 | 6/1982 | Findeis et al. | 355/27 |
| 4,365,895 | 12/1982 | Shaber et al. | 356/298 X |
| 4,464,035 | 8/1984 | Schoering | 354/299 |
| 4,464,036 | 8/1984 | Taniguchi et al. | 354/324 |
| 4,468,123 | 8/1984 | Miller | 356/404 |
| 4,492,474 | 1/1985 | Miller | 356/404 |
| 4,527,878 | 7/1985 | Taniguchi et al. | 354/298 |
| 4,642,276 | 2/1987 | Burtin | 430/30 |
| 4,676,628 | 6/1987 | Asbury, III | 355/38 |
| 4,881,095 | 11/1989 | Shidara | 354/298 |
| 4,888,612 | 12/1989 | Yamamoto | 355/35 |
| 5,051,776 | 9/1991 | Mancino | 355/77 |
| 5,063,583 | 11/1991 | Galkin | 378/207 |
| 5,083,152 | 1/1992 | Tokuda | 355/27 |
| 5,194,887 | 3/1993 | Farling et al. | 354/299 |
| 5,319,408 | 6/1994 | Shiota | 354/298 |

FOREIGN PATENT DOCUMENTS 0610811 8/1994 European Pat. Off. .... G03D 13/00

OTHER PUBLICATIONS

Patent Abstracts of Japan JP62294241, Ohara Yuji, Optical Scanning Recorder, May 31, 1988, vol. 12, No. 185 (P-710).

Patent Abstracts of Japan JP5257256, Shioda Kazuo, Processing Performance Maintaining Method And Automatic Developing And Printing Device, Jan. 13, 1994, vol. 18 No. 21 (P-1674).

Patent Abstracts of Japan JP58014836, Taniguchi Hiroshi et al., Controlling Method For Correction Of Oxidation By Testing Of Test Piece In Automatic Developing Machine, Apr. 9, 1983, vol. 7 No. 87 (P-190).

*Primary Examiner*—D. Rutledge

*Attorney, Agent, or Firm*—David A. Howley

[57] ABSTRACT

A processor including means for processing a photosensitive material to render latent images of photographed subjects on the photosensitive material visible, means for automatically reading a visible test indicia on the photosensitive material to determine predetermined characteristics of the test indicia and means for determining whether or not the characteristics of the visible test indicia are within a predetermined range. Also included are means for automatically creating a latent image of the test indicia on the photosensitive material. The processing means are adapted to process the photosensitive material to render the latent image of the test indicia visible. Further included are means for adjusting the processing means, if the characteristics of the visible test indicia are not within the predetermined range, to control one or more processing parameters of the processing means.

7 Claims, 5 Drawing Sheets

PHOTOSENSITIVE MATERIAL PROCESSOR

FIELD OF THE INVENTION

This invention relates generally to the field of photography, and, more particularly, to the processing of photosensitive material such as silver-halide based film and paper.

BACKGROUND OF THE INVENTION

In the photographic art, processors are used to render latent images on photosensitive material visible and nonphotosensitive. Typical processors include a series of liquid baths which develop, bleach, fix and rinse (wash) the photosensitive material.

Processor control monitoring is desired for daily start-up and intermittent monitoring of the processor or for image quality problem diagnostic information. Processor control in a typical system, such as the Noritsu QSS 1201, is maintained by the use of control strips. These control strips are specially exposed photosensitive materials usually made by the material manufacturer and provided at a cost to the photofinisher. In a photographic printer, the control strips are used to monitor the processor section isolated from the imaging operation.

In use, the refrigerated control strip is warmed up to ambient temperature, taken to a darkroom, removed from its light-tight package, placed in a dark bag or paper magazine and taken to the processor. A leader card is then attached to the leading edge of the control strip. All processing of photosensitive material is halted. The leader card is inserted into a special light tight slot in the processor where it tows the process control strip through the processor.

The processed control strip is removed from the leader card and brought to a densitometer, such as the X-Rite Model 810, which takes readings of the control strip. The readings from the densitometer are compared to process limits and/or plotted on a hand or off-line computer chart. The processor is considered (1) in control if the densitometer readings fall within acceptable control limits or (2) out of control when the readings fall outside of the control limits. If the processor is out of control, appropriate quality corrective action is initiated. After the corrective action is complete, the above procedure is repeated to determine if the processor is within the control limits.

U.S. Pat. No. 5,083,152 (the '152 reference) discloses a photographic processing device including an exposing section for printing an image on a light-sensitive material in accordance with exposure conditions. A processor section performs developing, fixing, washing and drying operations with respect to the printed light sensitive material. A density measuring unit provided in the vicinity of the light-sensitive material exit side of the processor section photometers the light sensitive material to provide an image density signal. A unit corrects the exposure conditions in accordance with the image density signal.

PROBLEMS TO BE SOLVED BY THE INVENTION

Processor control in a typical system, such as the Noritsu QSS 1201, is time consuming, expensive and requires cold storage for the control strips. Processor control also interrupts the processor from processing photosensitive material, thereby decreasing productivity. For the above reasons, processor control is not always accomplished as often as it should be, resulting in an increased risk of diminished image quality.

In the '152 reference, only the exposure conditions are being corrected: there is no disclosure directed to correcting the processor. Further, the exposing section is not isolated from the processor section during calibration. As such, if the image density signal indicates that corrective action needs to be taken, it will not be clear whether the exposing section or the processor section or both should be adjusted. In addition, a special reference color negative film 52 is used to create a test image on the photosensitive material. Having to create such a reference negative film is inconvenient and adds extra cost to the system.

SUMMARY OF THE INVENTION

According to one aspect of the invention, a processor includes means for processing a photosensitive material to render latent images of photographed subjects on the photosensitive material visible, means for automatically reading a visible test indicia on the photosensitive material to determine predetermined characteristics of the test indicia and means for determining whether or not the characteristics of the visible test indicia are within a predetermined range. Also included are means for automatically creating a latent image of the test indicia on the photosensitive material. The processing means are adapted to process the photosensitive material to render the latent image of the test indicia visible. Further included are means for adjusting the processing means, if the characteristics of the visible test indicia are not within the predetermined range, to control one or more processing parameters of the processing means.

ADVANTAGEOUS EFFECTS OF THE INVENTION

The present invention allows a processor to be calibrated without the inconvenience and cost of having to use control strips. By calibrating "on the fly" directly onto photosensitive material used to capture photographed subjects, productivity is increased. Because calibration of the processor is less disruptive in the present system than in prior art processors, calibration can be accomplished more often, resulting in enhanced image quality.

DETAILED DESCRIPTION OF THE INVENTION

The invention is disclosed as being embodied in a photosensitive material processor. Because the features of a photosensitive material processor are generally known, the description which follows is directed in particular only to those elements forming part of or cooperating directly with the disclosed embodiment. It is to be understood, however, that other elements may take various forms known to a person of ordinary skill in the art.

Figure 1:
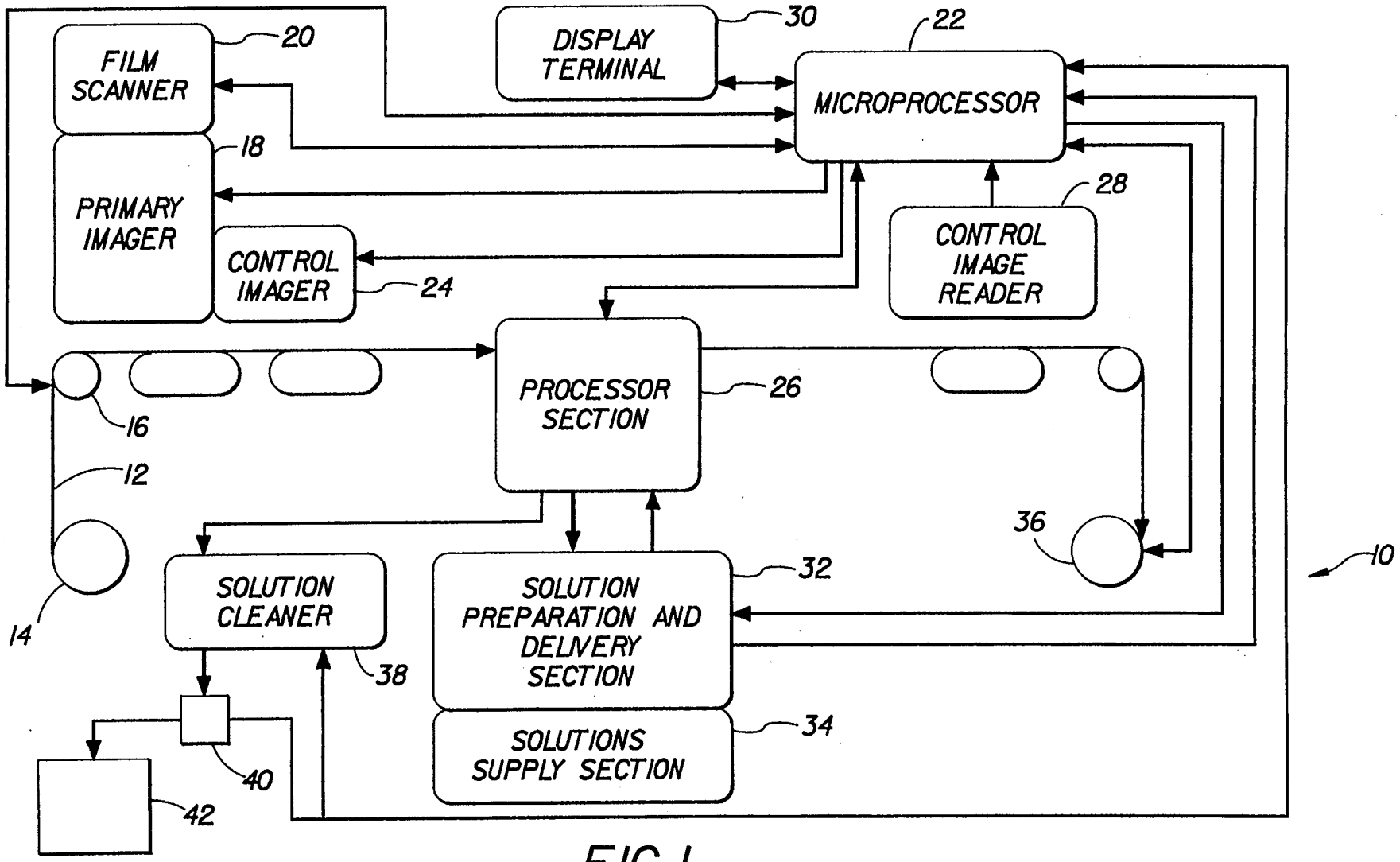
FIG. 1 is a schematic illustration of a photosensitive paper processor.

Referring now to the drawing, FIG. 1 shows a photosensitive material processor designated generally by the reference numeral 10. Photosensitive material, such as silver halide based paper 12, is fed from a supply roll 14 over a drive roller 16. Paper 12 passes by a primary imager 18 which preferably includes a film scanner 20. Film scanner 20 scans a photographic filmstrip (not shown), having images of photographed subjects recorded thereon, to determine exposure conditions for each image on the filmstrip.

A microprocessor 22, used to operate photosensitive material processor 10, controls the rate at which paper 12 is introduced into primary imager 18 by controlling the rotational speed of drive roller 16. When it is time to record an image onto paper 12, microprocessor 22 momentarily halts movement of paper 12. Microprocessor 22 then directs primary imager 18 to expose an image on the filmstrip onto paper 12 in accordance with exposure conditions determined by scanner 20. This process is repeated successively, causing a series of latent images to be recorded on paper 12.

Periodically, a processor calibration routine is entered. The processor calibration routine can be initiated manually by an operator or periodically by microprocessor 22. Primary imager 18 is directed by microprocessor 22 to leave an area of paper 12 unexposed. This area of unexposed paper is preferably at the beginning of a roll of paper or between orders of images recorded on the paper. Microprocessor 22 momentarily halts movement of paper 12 such that the unexposed section of paper is adjacent a control imager 24. Control imager 24, such as a minisensitometer, light emitting diode array, cathode ray tube or strobe, creates a latent test indicia in the unexposed area of paper 12 by emitting light in a pattern corresponding to the test indicia. The test indicia have predetermined characteristics such as a known density or densities.

Paper 12 next passes through a processor section 26. Processor 26 includes a series of liquid baths which develop, bleach, fix and rinse (wash) paper 12. By exposing paper 12 to these baths, the latent images on the paper are rendered visible and the paper is rendered nonphotosensitive. Processor 26 also includes a dryer section (not shown) for removing any remaining bath fluid from the paper.

Upon exiting processor 26, paper 12 passes by a control image reader 28 which includes a densitometer. Movement of paper 12 is momentarily halted. The density of the test indicia on paper 12 is then read by reader 28 and compared to a predetermined range stored in microprocessor 22. When the density of the test indicia is at or within the predetermined range, processor 26 does not need to be adjusted. When the density of the test indicia is outside of the predetermined range, processor 26 should be adjusted to insure that image quality is maintained. A display terminal 30 is provided so that an operator can monitor the system status.

When processor 26 needs to be adjusted, one or more processing parameters of processor 26 are changed. The processing parameters can be changed manually by an operator or automatically by microprocessor 22. When the density of the test indicia is too high, the rate at which paper 12 passes through processor 26 can be increased. Paper 12 spends less time in the processor baths resulting in less image development and lower image density. Conversely, if the density of the test indicia is too low, the rate at which paper 12 passes through processor 26 can be decreased to raise density. The rate at which paper 12 passes through processor 26 is adjusted by altering the processor speed.

A second processing parameter which can be adjusted to control image density is the rate at which fresh solution(s) is/are delivered to processor 26. When image density needs to be increased, the rate of delivery of fresh solution is elevated. When image density needs to be decreased, the rate of delivery of fresh solution is lowered. The solution which has the greatest impact on image density is the developer solution. The fix and rinse solutions have a lesser impact on image density.

The rate of delivery of fresh solutions to processor 26 is controlled by a solution preparation and delivery section 32. A solutions supply section 34 provides fresh solutions, some or all of which may be in concentrated form, to preparation and delivery section 32. Preparation and delivery section dilutes the fresh solutions, if necessary, and introduces them into a recirculation system. The recirculation system includes recirculation pumps (not shown) which circulate the solutions between processor 26 and preparation and delivery section 32. Preparation and delivery section 32 also includes filters for filtering the solutions.

A third parameter which effects the density of images is the rate of recirculation of the processing solutions between processor 26 and preparation and delivery section 32. A higher rate of recirculation results in greater agitation of the processing fluids and higher image density. Conversely, a lower rate of recirculation results in less agitation of the processing fluids and lower image density.

A fourth parameter which effects the density of images is the temperature of the solutions used in processor 26. When the density of the test indicia is too high, the preparation and delivery section will cool down the solutions to slow down development, thereby lowering image density. When the density of the test indicia is too low, the preparation and delivery section will heat up the solutions to speed up development. The temperature of the developer solution has the greatest impact on image density while the temperature of the fix and rinse solutions has a lesser impact on image density. Heating and cooling of the solutions is accomplished by a heat transfer unit within preparation and delivery section 32.

A fifth parameter which effects the density of images is the quality of the processing solutions. When the processing solutions become contaminated, image density is effected with a resultant degradation in image quality. When the detected image density of the test indicia indicates that a processing solution is contaminated, the contaminated solution is manually or automatically removed from processor 26 and replaced with fresh solution. Contaminated solutions are removed from the processor and transferred to a solution cleaner 38 which includes filters for filtering impurities from the solutions. A purity monitor 40 checks the quality of the filtered solutions. The filtered solutions are then sent to a solution disposition section 42 where the filtered solutions are either disposed of or reused.

Figure 2:
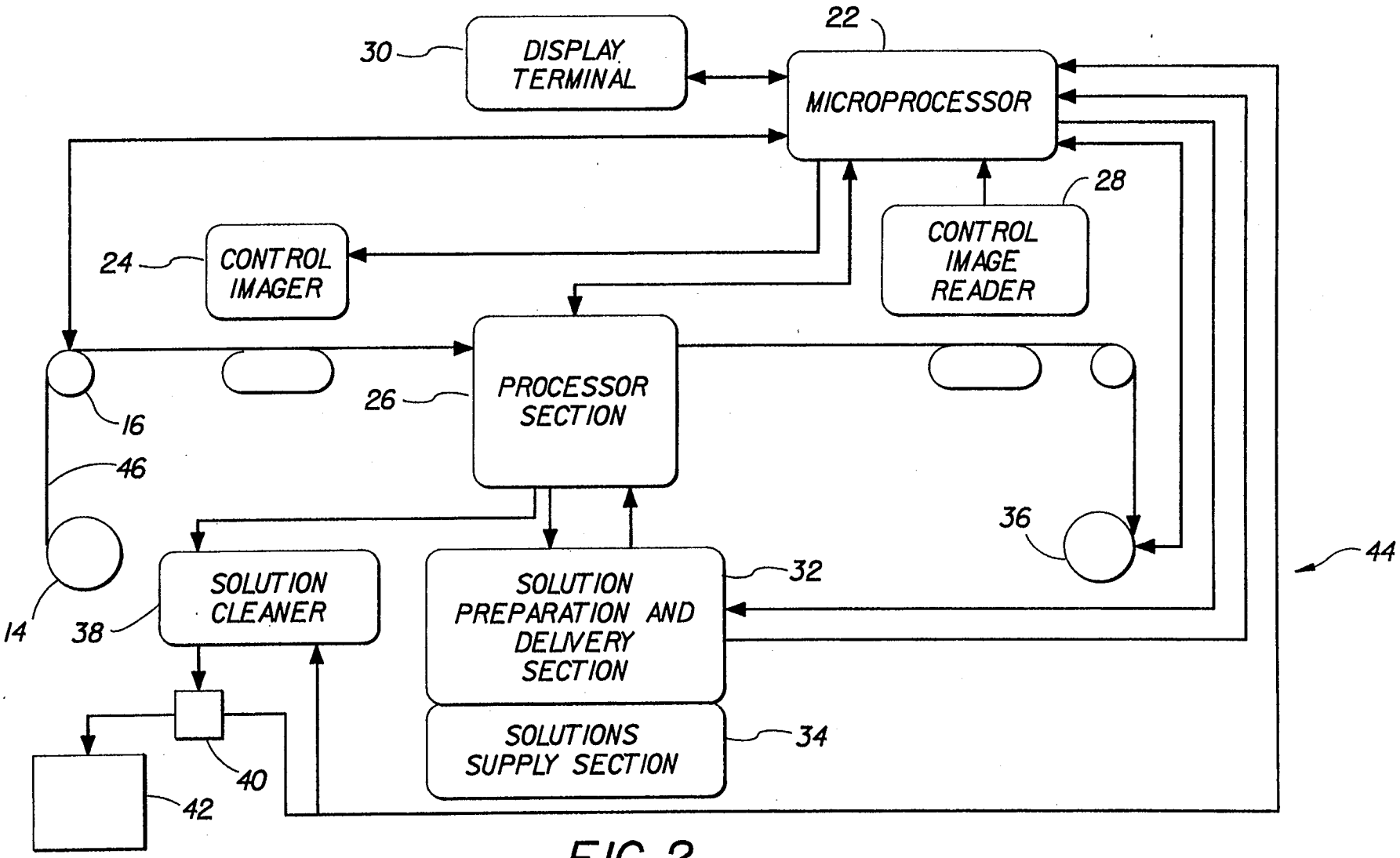
FIG. 2 is a schematic illustration of a photosensitive film processor.

FIG. 2 represents an alternative photosensitive material processor 44 used to process silver-halide based film 46. Images are recorded on film 46 by, for example, a camera. As a result, there is no need for a primary imager or film scanner as shown in FIG. 1. The remainder of processor 44 is essentially the same as processor 10. Film 46 includes one or more image-bearing filmstrips. When there is a plurality of filmstrips, the filmstrips are spliced together at their ends. Control imager 24 creates a test indicia on an unexposed area of the film, preferably at the leading or trailing end of one of the filmstrips. Alternatively, control imager 24 can create a test indicia on an unexposed filmstrip, having no images thereon, which is spliced into the other filmstrips.

Control imager 24 and control image reader 28 can be calibrated at the factory, during installation into the photosensitive material processor, during servicing of the photosensitive material processor or at a standard interval. Calibration can be accomplished by a standard calibration procedure known in the art such as, for example, setting control imager 24 and control image reader 28 to match or directly correlate with a known control image strip.

Figure 3A:
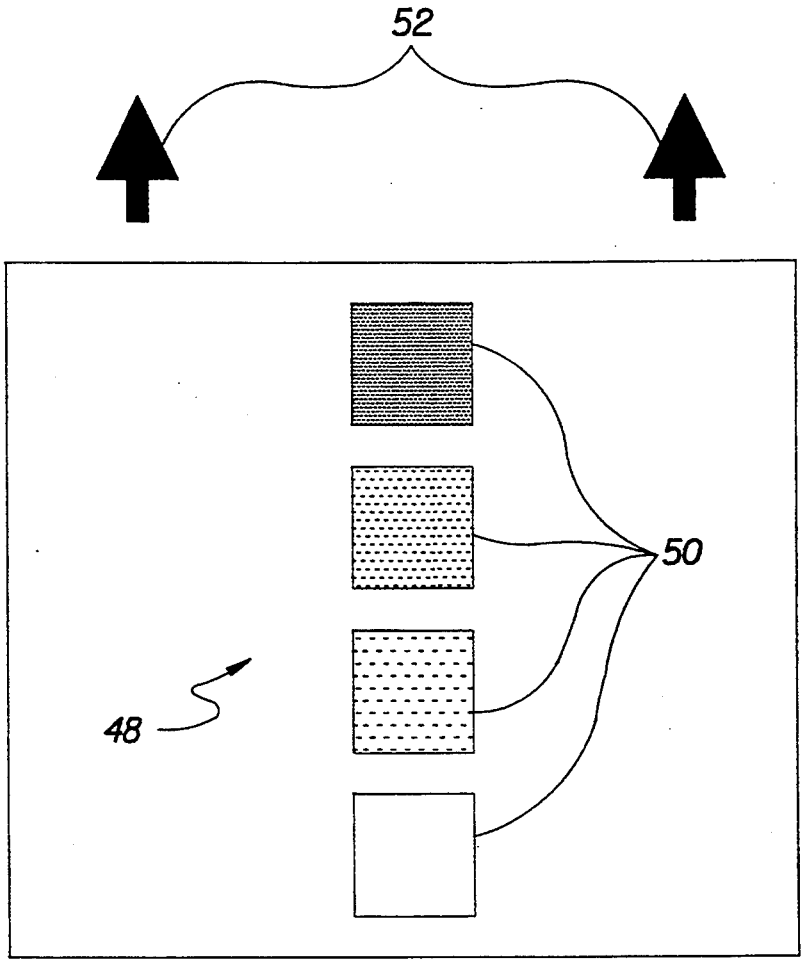
FIGS. 3A–C are schematic illustrations of test indicia.
Figure 3B:
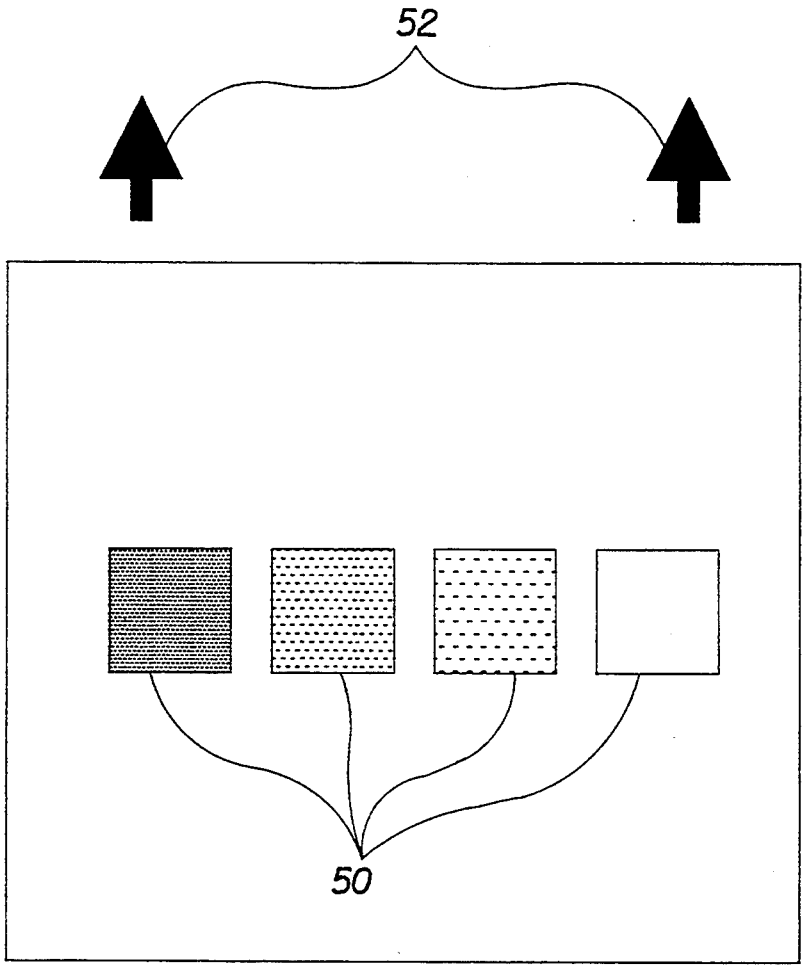
Figure 3C:
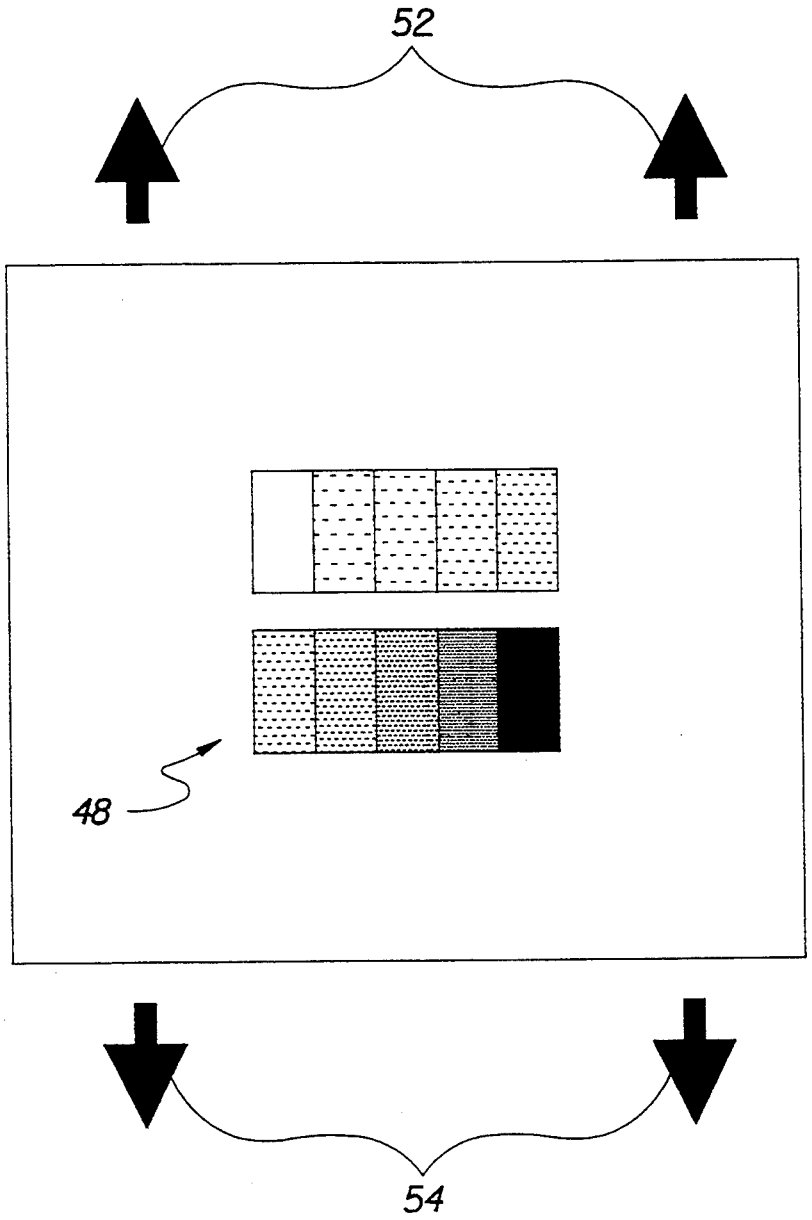

FIGS. 3A–C represent various test indicia used to calibrate processor 26. In FIG. 3A, test indicia 48 includes four patches 50. Each patch has an image density different from the other patches. Arrows 52 show the direction of movement of the photosensitive material on which the indicia are located. Movement of the photosensitive material is halted when the highest density patch is adjacent the densitometer. The density of the highest density patch is read by the densitometer. The photosensitive material is then moved until the next patch is adjacent the densitometer. This process continues until all the patches have been read.

In FIG. 3B, patches 50 are oriented across the width of the photosensitve material. In this case, after the movement of the photosensitve material is halted, the densitometer is moved across the width of the photosensitive material from patch to patch, momentarily stopping at each patch to take a density reading.

FIG. 3C displays two rows of patches containing a total of ten patches. The photosensitve material can be moved in the direction shown by arrows 52 or 54. In this case, movement of the photosensitve material is halted when one of the rows of patches is adjacent the densitometer. The densitometer is then moved across the row, taking a density reading at each patch. After the last patch is read, the photosensitve material is moved such that the other row of patches is adjacent the densitometer. The densitometer then takes a reading of each of the patches in this row. Any number of patches oriented in any direction can be used in the calibration of the processor section.

The invention has been described with reference to a preferred embodiment. However, it will be appreciated that variations and modifications can be effected by a person of ordinary skill in the art without departing from the scope of the invention.

PARTS LIST FOR FIGS. 1–3

10 Photosensitive Material Processor
12 Paper
14 Supply Roll
16 Drive Roller
18 Primary Imager
20 Film Scanner
22 Microprocessor
24 Control Imager
26 Processor Section
28 Control Image Reader
30 Display Terminal
32 Solution Preparation and Delivery Section
34 Solutions Supply Section
36 Take-Up Roll
38 Solution Cleaner
40 Purity Monitor
42 Solution Disposition Section
44 Photosensitive Material Processor
46 Film
48 Test Indicia
50 Patches
52 Arrows
54 Arrows

What is claimed is:

1. In a processor having means for processing a photosensitive material to render latent images of photographed subjects on the photosensitive material visible, means for automatically reading one or more visible test indicia, located on the same photosensitive material bearing the images of photographed subjects, to determine predetermined characteristics of the test indicia, and means for determining whether or not the characteristics of the visible test indicia are within a predetermined range, the improvement comprising:

means for automatically creating a latent image of the test indicia on said photosensitive material;

said processing means being adapted to process said photosensitive material to render said latent image of the test indicia visible, said visible test indicia including a plurality of images having different image densities from each other; and means for adjusting said processing means, if the characteristics of said visible test indicia are not within said predetermined range, to control one or more processing parameters of said processing means.

2. The processor of claim 1, wherein said creating means includes an apparatus which emits light in a pattern corresponding to said test indicia.

3. The processor of claim 1, wherein the adjusting means includes means for altering the temperature at which said photosensitive material is processed by said processing means if the characteristics of said visible test indicia are not within said predetermined range.

4. The processor of claim 1, wherein the adjusting means includes means for altering the rate at which fresh processing fluids are supplied to said processing means if the characteristics of said visible test indicia are not within said predetermined range.

5. The processor of claim 1, wherein the adjusting means includes means for altering the speed with which said photosensitive material is processed by said processing means if the characteristics of said visible test indicia are not within said predetermined range.

6. The processor of claim 1, wherein the adjusting means includes means for altering the rate at which one or more processing fluids in said processing means are recirculated if the characteristics of said visible test indicia are not within said predetermined range.

7. The processor of claim 1, wherein the adjusting means includes means for replacing one or more contaminated processing fluids in said processing means with fresh processing fluid if the characteristics of said visible test indicia are not within said predetermined range.

* * * * *

UNITED STATES PATENT AND TRADEMARK OFFICE

CERTIFICATE OF CORRECTION

PATENT NO. : 5,440,365
DATED : August 8, 1995
INVENTOR(S) : Edgar P. Gates, et al It is certified that error appears in the above-indentified patent and that said Letters Patent is hereby corrected as shown below:

Title Page Under Inventors "John H. Hilton" should be --John H. Rosenburgh--

Signed and Sealed this

Twenty-sixth Day of December, 1995

*Attest:*

*Attesting Officer*

BRUCE LEHMAN

*Commissioner of Patents and Trademarks*